United States Patent [19]

Dale

[11] 4,312,602

[45] Jan. 26, 1982

[54] WET CONCRETE PAVEMENT SPREADING MACHINE AND REINFORCING ROD LAYER

[75] Inventor: Charles H. Dale, Rock Island, Ill.

[73] Assignee: Pav-Saver Mfg. Co., East Moline, Ill.

[21] Appl. No.: 95,455

[22] Filed: Nov. 19, 1979

[51] Int. Cl.[3] ..... E01C 23/04

[52] U.S. Cl. ..... 404/100

[58] Field of Search ..... 404/100, 102, 108, 83, 404/84, 88

[56] References Cited

U.S. PATENT DOCUMENTS

| | | | |
|---|---|---|---|
| 1,893,559 | 1/1933 | Lichtenberg | 404/100 |
| 2,030,315 | 2/1936 | Noble | 404/102 |
| 2,123,989 | 7/1938 | Day | 404/102 |
| 2,175,240 | 10/1939 | Arthur | 404/100 |
| 2,396,426 | 3/1946 | Jackson | 404/102 |
| 3,331,296 | 7/1967 | Perkins | 404/100 |
| 3,606,827 | 9/1971 | Miller | 404/84 |
| 3,849,016 | 11/1974 | Cochrane | 404/100 |

*Primary Examiner*—Nile C. Byers, Jr.

*Attorney, Agent, or Firm*—Matthew C. Thompson

[57] ABSTRACT

Machines for spreading wet concrete pavement and/or laying reinforcing rods in the spread wet concrete embodying a main frame movable along a subgrade for pavement by power-driven endless tracks, one or two power-driven, transverse, rotatable augers for spreading wet concrete laterally between slip form side plates and ahead of a height-adjustable strike-off blade or plate on the frame, said side plates optionally including plates projecting forwardly of the machine from opposite sides thereof, and a cross plate extending transversely between respective forward portions of said plates to define a three-sided enclosure into which wet concrete to be spread by said machine may be dumped, and a plurality of height-adjustable, side-by-side, substantially horizontal tubes extending in the forward-to-rearward direction and along the lower side of said three-sided enclosure at a level at which reinforcing rods, which pass through said tubes, are to be placed in the spread wet concrete, the rearward, exit ends of said tubes being near and below said auger(s) and ahead of the strike-off plate or blade.

16 Claims, 5 Drawing Figures

WET CONCRETE PAVEMENT SPREADING MACHINE AND REINFORCING ROD LAYER

INTRODUCTION

This invention in general relates to improvements in machines for spreading wet concrete pavement on a roadway subgrade for the pavement and also to improvements for laying longitudinal steel reinforcing rods in the spread, wet concrete, pavement layer left by the machines as they move forwardly along the subgrade. There are two types of machines for laying and spreading wet concrete. One type is known as a form-type paver which works in conjunction with pre-set forms placed along the subgrade and define the sides of the pavement strip being laid. The wet concrete spreader usually is a component of a form-paving machine which spreads, levels, tamps and surface-finishes the wet concrete strip between the forms, and which either moves longitudinally along the forms on wheels, endless tracks, or the like, or lays on top of the forms and is drawn slidably by a cable-drum mechanism forwardly along the forms. The other type of spreader is a slip-form-type machine which does not require pre-laid side forms for the pavement. Such spreader, often used as a component of a slip-paver which spreads, levels, tamps and surface-finishes the wet concrete strip, is used with low slump concrete. The side edges of the wet concrete strip are formed between side plates on opposite sides of the slip-form paver, such side plates usually extending a substantial distance from the front to the rear of the paver and provide a dwell-time of the low slump concrete between the side plates sufficient so that the side edges of the laid, wet concrete strip substantially retain their shape after the strip passes out of the rear ends of the side plates. Where additional dwell time is required or is desirable, trailing forms embodying side plate-extensions of the side plates of the slip form paver may be coupled to the rear of the paver and pulled forwardly therewith as the paver moves along the pavement subgrade.

In addition to spreading and levelling of the wet concrete in the form of a rough-finished pavement strip, the machine of the invention may embody means for laying longitudinal, steel reinforcing rods in the wet pavement layer at a predetermined depth in the layer. Preferably, such rod-laying means comprise a plurality of substantially horizontal, forwardly-to-rearwardly extending, side-by-side tubes. The reinforcing rods are fed into the forwardmost, entrant ends of the tubes, and slide rearwardly in the tubes as the machine progresses forwardly along the pavement subgrade. The rearwardmost, exit ends of the tubes are located near and below the augers or other spreader means for spreading the dumped concrete laterally between slip-form type plates extending longitudinally along opposite sides of the machine. Said ends further preferably are located ahead of and below the lower edge of a strike-off blade or plate which is height-adjustably mounted on the main frame of the machine and extends transversely across the machine from side plate to side plate. This strike-off plate trims the concrete layer to provide the desired thickness of the pavement layer, the upper surface of which usually is later smoothed and finished by a following slip-form paver which has means for further striking off a small segment of the wet concrete layer along the upper surface thereof to the final depth called for in the highway specifications, and also has means for imparting a round or a planar shape to the finished upper surface of the concrete layer as well as means for providing the surface finish and smoothness called for in the specification. Transverse grooving to cut light glare and/or reduce hydroplaning tendencies of automotive tires on the pavement, where called for in the specifications, is usually done by a third machine or by manually dragging a groover transversely across the surface of the wet concrete strip.

Still another feature of the invention is the provision of a three-sided enclosure formed by side plates and a cross plate positioned ahead of the spreader and pushed along the sub-grade by the spreader. A pair of wheels or the like at the forward end of the three-sided enclosure supports same above the surface of the subgrade. Wet concrete, which is usually carried to the paving site by trucks (but which can also be prepared on site in mixers moved along the road bed as the paving progresses) is dumped in a pile or piles within the three-sided enclosure and confined therein until the piles are spread by the spreader means of the machine. Where reinforcing rod-laying tubes are used in conjunction with the spreader which also embodies the three-sided enclosure, such tubes extend longitudinally along the underside of the three-sided enclosure from the feed end ahead of the cross wall to an exit end below and near the spreader means and ahead of and below the strike-off plate or blade. Field tests with pavement spreading machines of this type have proved, surprisingly, that the reinforcing rods can be positioned within $\pm$174" of the depth in the concrete layer called for in the pavement specifications. The laid reinforcing rods are completely and compactly surrounded by the wet concrete layer which exits from the rear side of the spreader.

PRIOR ART

The subject spreader machine for spreading wet concrete pavement in a slip-form type of operation embodies several novel improvements over spreaders heretofore known in the prior art, including those spreader components which constitute part of a slip-form paving machine which also tamps and finishes the layer of wet concrete initially spread and rough-grade levelled by the spreader and strike-off components. An example of the slip form paver which utilizes a transverse, split, reversibly rotatable auger for spreading wet concrete between the side plate, slip forms carried by the machine and an adjustable strike-off plate or blade following such auger, is dislosed in my U.S. Pat. No. 3,905,715, issued Sept. 16, 1975.

This machine, preferably with its spreading auger raised to inactive position, can be used as the slip form finishing machine which follows the wet concrete pavement spreading machine of the subject invention in order to provide the final level, crown (if any) and finish for the pavement strip.

No prior art pavement-spreader machines which utilize the wheel-supported, three-sided, plate enclosure ahead of the spreading auger or augers and strike-off blade or plate as afore-described, are known in the art. There are, however, known paving machines which lay longitudinal, steel, reinforcing rods in the freshly laid, wet concrete pavement as the paving machine progresses along the subgrade. One such machine is described in G. E. Perkins et al. U.S. Pat. No. 3,331,296, issued July 18, 1967. In this patent parallel, U-troughs are suspended from the paver at height-adjustable levels determined by the depth at which the reinforcing rods are to be laid in the wet concrete strip. The rods enter the troughs ahead of the previously dumped wet concrete and move rearwardly through the troughs as the paving machine moves forwardly along the roadway subgrade. The rearward, exit ends of the troughs terminate forwardly of the rearward end of finishing means, i.e., extrusion meter and a transversely reciprocating belt. The troughs themselves extend below members on the machine for levelling above and densifying about the rod the concrete mass until it is capable of supporting the rods at the specified elevations and transverse spaces. The troughs themselves are preferably supported on the machine by individual, relatively thin plates which present minimum obstruction to the concrete.

Another machine for laying reinforcing members in wet concrete, pavement strips as disclosed in Day U.S. Pat. No. 1,112,989, issued July 19, 1928 lays steel, reinforcing mesh in the wet concrete. The mesh, which initially lays on the pavement subgrade, is elevated and passes over a horizontal slit in a downwardly depending plate portion of a concrete hopper carried on the paver. The paver in this case is a form paver having flange wheels which move on the top edges of the previously laid forms. The wet concrete passes through the wire mesh below the hopper and its upper surface is levelled by a horizontal plate or screed position just behind the hopper opening. A series of vertical, horizontally spaced plates just below the hopper opening support on their upper edges the mesh reinforcement as it passes across the hopper opening.

BRIEF DESCRIPTION OF THE INVENTION

Briefly, this invention involves machines and their components for laying reinforcing rods in wet concrete pavement. Such machines comprise a frame and power-driven means supporting said frame for movement along a subgrade for pavement. There are spreader means on said frame for spreading wet concrete laterally over the subgrade as said machine moves forwardly along the subgrade. A plurality of substantially horizontal, side-by-side tubes are mounted on said machine at a level and at horizontal spacings at which reinforcing rods are to be placed in the wet concrete. They extend in a forward-to-rearward direction relative to the machine. The rearward, exit ends of said tubes are preferably positioned below and adjacent to the spreader means.

Preferably, and usually, the spreader means comprises at least one power driven auger rotatably mounted on and extending transversely across said frame. The rearward, exit ends of said tubes are positioned below and adjacent to said auger. A strike-off plate or blade is mounted on said frame near and rearward of the auger and has a lower edge extending transversely across said machine at a height relative to the subgrade so as to leave a layer of wet concrete of the desired thickness on the subgrade as said machine moves forwardly therealong. Accordingly, the spreader means extends transversely across the frame ahead of said strike-off blade or plate and above said lower edge of said strike-off blade. The rearward, exit ends of the tubes are positioned below and ahead of said lower edge of said plate or blade and below and adjacent to said spreader means.

Preferably, the spreader means includes a power-driven, rotatable auger extending transversely across said machine immediately ahead of said strike-off plate or blade, and the rearward, exit ends of said tubes are positioned below and ahead of said auger. The spreader means may also include a second, power-driven, rotatable auger substantially parallel to and ahead of the other auger, in which case the rearward, exit ends of said tubes advantageously are below and between the two augers.

Another aspect of the invention involves machines for spreading wet concrete pavement, with or without the reinforcing rod guide tubes. They comprise a frame, power-driven means supporting the frame for movement along a subgrade for pavement, and spreader means mounted on the frame for spreading wet concrete laterally over the subgrade as said machine moves forwardly along the subgrade. Plate means are mounted on the machines and project forwardly therefrom. The plate means include a pair of side plates respectively extending forwardly from opposite sides of the machines and a cross plate extending transversely between respective forward portions of the side plates. The three plates define a three-sided enclosure into which wet concrete may be dumped in order to be spread by the spreader means, e.g., the aforesaid auger or augers. Optionally, a plurality of side-by-side, substantially horizontal, reinforcing rod guide tubes extend in a forward-to-rearward direction relative to the machines and along the lower side of said three-sided enclosure at a level and at horizontal spacings at which reinforcing rods are to be placed in said wet concrete. It is preferred that the forwardmost, entrant ends of the tubes are ahead of said cross wall, while, as aforestated, the rearward, exit ends of the tubes are near and below said spreader means.

The fourth side of the rectilinear enclosure preferably is a strike-off plate or blade mounted on and extending transversely across said frame rearwardly of the spreader means. A pair of wheels are mounted on opposite sides of the forward portions of said three-sided enclosure by means for selectively and adjustably raising or lowering the height, relative to said wheels, of said forward portions of said enclosure and the forward, entrant ends of any reinforcing rod guide tubes mounted on the enclosure in positions lower than the bottom edge of the cross wall.

PREFERRED EMBODIMENTS

Preferred forms of the invention are illustrated in the drawings, wherein.

Figure 1:
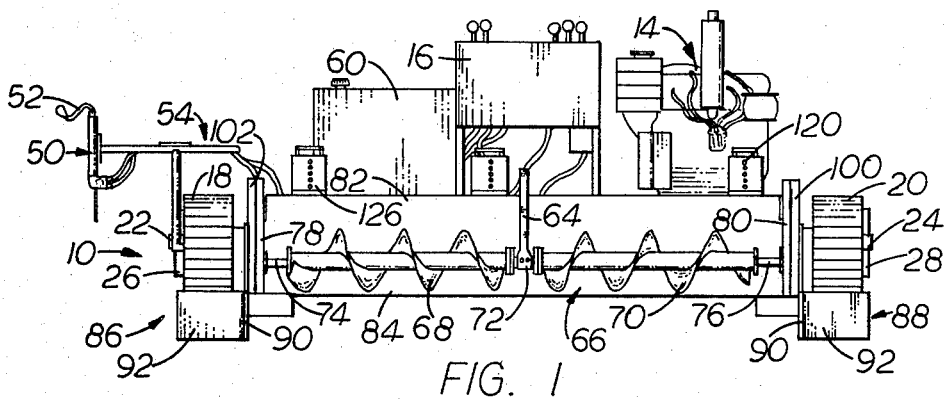
FIG. 1 is a front elevation of a wet concrete pavement spreader machine without the wheel-supported, three-sided enclosure or the reinforcing rod guide tubes.
Figure 2:
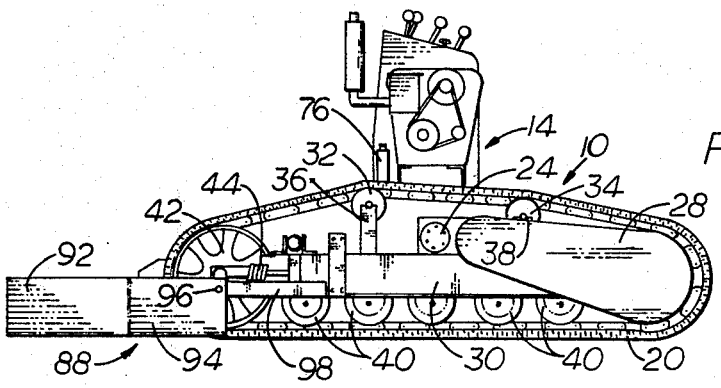
FIG. 2 is a side elevation of said spreader machine.
Figure 3:
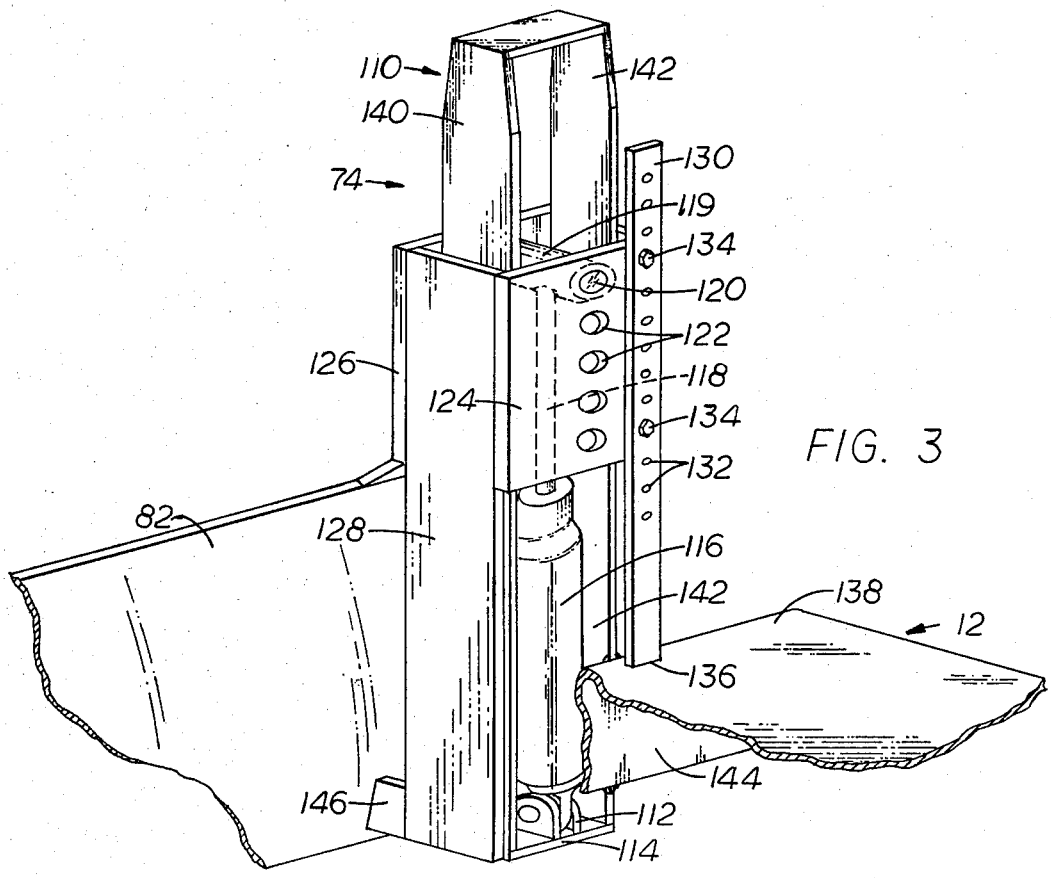
FIG. 3 is a perspective, fragmentary, detail view of the parts used to mount one side of the height-adjustable strike-off blade or plate on the machine frame.
Figure 4:
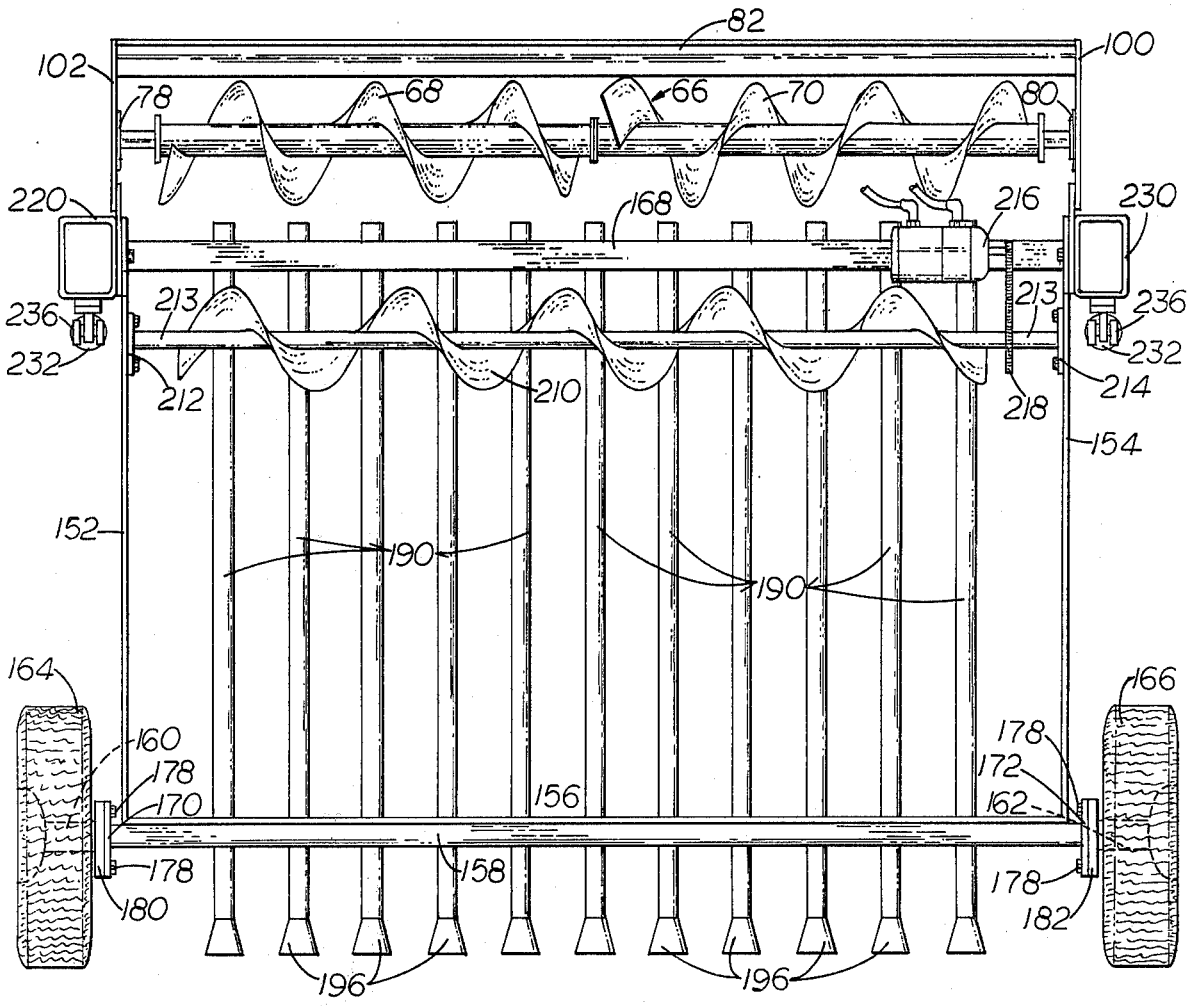
Figure 5:
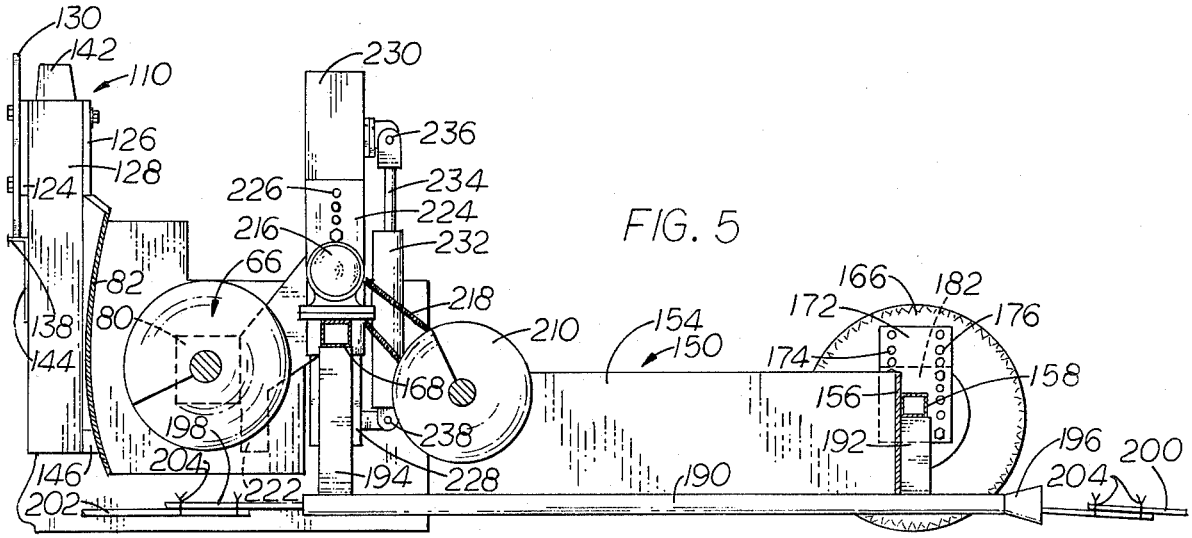

FIG. 4 is a fragmentary, top plan view of the wheel-supported, three-sided plate enclosure to be mounted on and ahead of the spreader machine of FIGS. 1—3 with a second, rotatable, transverse auger and a plurality of horizontally spaced, forwardly-to-rearwardly extending, reinforcing rod guide tubes mounted on and below the three-sided enclosure; and FIG. 5 is a fragmentary, side elevation of the forward portion of the spreader machine of FIGS. 1—3 with the wheel-supported enclosure, and its auger and guide tubes as illustrated in FIG. 4, mounted on and ahead of the spreader machine.

Referring to the drawings a concrete spreading machine 10 is composed of a main frame 12 on which is mounted an internal combustion, gasoline or diesel engine 14, and a control panel box 16. The frame is supported on a pair of endless, side tracks 18, 20, which are driven by respective chain-and-sprocket transmissions (not shown in detail) by the respective hydraulic motors 22, 24. The chain-and-sprocket transmissions are housed within the chain drive housings 26, 28, and respectively drive the rear, track, drive wheels (not shown).

Upper, track guide wheels 32, 34 are supported by arms 36, 38 mounted on respective side beams 30 of the main frame 12. Lower, track guide wheels 40 support the main weight of the machine on the lower flight of the respective tracks 18, 20. These weight-bearing, guide wheels are rotatably journalled on the main frame components of the machine. A pair of front, idler wheels 42 about which the respective tracks pass are mounted on the main frame by tension-adjustable spring mountings 44.

Preferably, the spreading machine has a pair of front and rear, stringline feeler devices 50 mounted on and projecting from one side of the machine, e.g., by the T-bar supports 54. Crank arms 52 adjust the vertical height of the feeler devices relative to the machine frame and its tracks by means of screw-threaded mechanisms (not shown).

The machine has a hydraulic reservoir unit 60 with hydraulic line(s) connecting the reservoir unit and the hydraulic components of the control panel box 16.

A support arm 64 is rigidly connected to the main frame 12 and bears on its lower end a bearing 72 in which are rotatably mounted respective ends of the flights 68, 70 of a split auger. Each auger flight 68, 70 is coupled at its outer end 74, 76 to a chain and sprocket drive (not shown) in the auger-bearing units 78, 80. Each chain and sprocket is driven by its own hydraulic motor (not shown) whereby each flight 68, 70 is rotatable independently of the other in either direction of rotation, depending upon the the direction of rotation imparted to its respective hydraulic motor.

An arcuate, strike-off blade or plate 82 extends transversely across substantially the full width between the tracks 18, 20. Its lower edge 84 determines the level at which the wet concrete, spread laterally by the split auger 66 just ahead of the strike-off blade or plate as the machine moves forwardly on its tracks 18, 20, is formed.

The lateral sides of the spread, wet concrete slab are formed by the inner plates 90, which are connected to respective diagonal plates 92 and respective outer plates 94. The outer plates 94 are mounted on a machine frame by respective bolts 96 coupled through the forward extension bar 98 on each side of the main frame. The inner plates 90 are connected to frame plates 100, 102 mounted on the machine frame.

The strike-off plate or blade 82 is vertically adjustably mounted on the frame of the machine by a pair of standards 110 (FIG. 3). Each box-like standard 110 has on its bottom wall 114 a pin connection 112 to which is coupled the lower end of the hydraulic cylinder 116. The cylinder rod 118 projects upwardly and has on its upper end a doughnut disc or yoke 119 coupled by pin 120, which projects through one of the several holes 122 in a vertical column, to the rear plate 124 of a box-like structure composed of the rear plate 124, front plate 126, attached to or integrally formed with the strike-off blade or plate 82, and two side plates 128. This box-like structure is vertically slidable on box-like standard 110.

The vertical bar 130 having a plurality of blade holes 132 in a vertical column thereon is attached by bolts 134 to the rear plate 124 and moves up and down with the box-like structure. The lower end 136 of the bar 130 comes to rest against a horizontal frame plate 138, and thereby supports the box-like structure and the strike-off blade or plate attached thereto. Variably height spacings of the strike-off blade or plate 82 are attained by mounting the bolts 134 in the desired bolt holes 132.

The side walls 140, 142 of the box-like standard 110 are welded to the vertical flange 144 of the horizontal frame plate 138. The lower outwardly curved portion of the strike-off plate or blade 82 is attached to the side plates 128 by the stub arms 146. Thus, by application of hydraulic pressure to the hydraulic cylinder 116 (one on each side of the strike-off plate or blade 82), the latter can be raised. To lower the blade or plate, the bar 130 is removed, whereby the blade or plate can be lowered by withdrawing hydraulic fluid from the cylinder 116. The bar 130 can be rebolted before or after the blade or plate is lowered.

Referring to FIGS. 4 and 5, the spreading machine 10 may have a forward extension 150 which is a three-sided enclosure made up of two, forwardly extending, side plates 152,154 connected at their forward ends by a front, cross plate 156. The latter is welded to the rectangular tube 158. Plates 170 and 172 are welded to opposite ends of the tube. Plates 170 and 172 are bolted to plates 180 and 182, respectively. They support the stub axles 160 and 162 of the rubber-tired wheels 164,166. The plates 170,172,180 and 182 each have two vertical columns 174,176 of bolt holes. Four bolts 178 in each plate pair 170,180 and 172,182 hold the wheels and their stub axles on the ends of the rectangular tube 158. The forward part of the three-sided enclosure can be raised or lowered relative to the wheels 164,166 by simply removing the bolts, raising or lowering the forward part and resetting the bolts to hold the forward part in the new, height-adjusted position.

A plurality of parallel, coplanar, reinforcing rod guide tubes 190 are welded at their forward end portions to the bottom edge of the cross plate 156. These rod guide tubes are spaced horizontally at the desired spacing for the concrete, reinforcing rods as called for in the highway specifications or other specifications, e.g., airport runway or taxiway specifications. They each have at their forwardmost ends a bell flare segment 196, which aids in guiding the reinforcing rods 198,200,202 into the tubes. The rods may be individually hand fed into each tube, but a faster, more preferable mode is to overlap respective ends of the rods, cf. FIG. 3, and tie the overlapped ends with wire or heavy twine or cord. Thus, the last part of each rod which enters the respective tube 190 guides the leading end of the following rod into tube.

The three-sided extension 150, optionally but preferably, has a single flight auger 210 which is driven in either direction of rotation by a chain-and-sprocket transmission 218 driven by the hydraulic motor 216. The ends of the auger shaft 218 are rotatably journalled in bearing blocks 212,214 which are bolted on the side plates 152,154 or on other suitable frame parts of the machine 10. The auger 210 provides the initial spreading of the dumped concrete piles while the split auger 66 is used to keep the wet concrete level above the entire length of the lower edge of the strike-off plate or blade 82.

The rear portion of the three-sided enclosure 150 is supported by a pair of vertical height adjustable means respectively mounted on vertical, rectangular frame tubes 220,230 on opposite sides of the machine. The piston rod 234 of the respective hydraulic cylinders 232 are connected by the pivot connections 236 to respective rectangular tubes 220,230.

The rearward ends of the tubes 190 are supported by vertical plates 194 which depend from the horizontal, rectangular tube 168. The ends of the latter are welded to the vertical plates 228, on which is mounted the ear 238, the latter being pivotally connected to the lower end of the hydraulic cylinder 232. The two hydraulic cylinders 236 are used to raise or lower the plate 228, which in turn raises or lowers the rectangular tube 168 and the rearward ends of the tubes 190.

The plates 228 overlap plates 224. Both plates have a vertical column of bolt holes 226 by which plate 228 can be locked in its height adjusted position by inserting one or more bolts through aligned holes 226 in the overlapping plates 224,228.

It will be appreciated from the foregoing that the invention herein can take many forms other than the preferred forms shown in the drawings and that the invention as herein claimed is not limited to the illustrated embodiments.

I claim:

1. A machine for laying reinforcing rods in wet concrete pavement which comprises a frame, power-driven means supporting said frame for movement along a subgrade for pavement, spreader means on said frame for spreading wet concrete laterally over said subgrade as said machine moves forwardly along said subgrade, and a plurality of substantially horizontal, side-by-side, cylindrical, open-ended, rod-guide tubes mounted on said machine at a level at which reinforcing rods are to be placed in said wet concrete and extending in a forward-to-rearward direction relative to said machine.

2. A machine as claimed in claim 1, wherein the rearward, exit end of said tubes is positioned below and adjacent to said spreader means.

3. A machine as claimed in claim 1, wherein said spreader means comprises at least one power driven auger rotatably mounted on and extending transversely across said frame, and the rearward, exit end of said tubes being positioned below and adjacent to said auger.

4. A machine as claimed in claim 1, a strike-off blade mounted on said frame and having a lower end extending transversely across said frame at a height relative to the subgrade to leave a layer of wet concrete of the desired thickness on said subgrade as said machine moves forwardly therealong, said spreader means, extending transversely across said frame ahead of said strike-off blade and above said lower edge of said strike-off blade, and the rearward, exit ends of said tubes being positioned below and ahead of said lower edge of said blade and below and adjacent to said spreader means.

5. A machine as claimed in claim 4, wherein said spreader means includes a power-driven, rotatable auger extending transversely across said machine immediately ahead of said strike-off blade, and the rearward, exit ends of said tubes being positioned below and ahead of said auger.

6. A machine as claimed in claim 5, wherein said spreader means also includes a second, power-driven, rotatable auger substantially parallel to and ahead of the other auger, and the rearward, exit ends of said tubes being below and between the two augers.

7. A machine for spreading wet concrete pavement which comprises a frame, power-driven means supporting said frame for movement along a subgrade for pavement, spreader means mounted on said frame for spreading wet concrete laterally over said subgrade as said machine moves forwardly along said subgrade, and plate means mounted on said machine and projecting forwardly therefrom and having a pair of side plates respectively extending forwardly from opposite sides of the machine and a cross plate extending transversely between respective forward portions of said side plates to define a three-sided enclosure into which wet concrete may be dumped to be spread by said spreader means.

8. A machine as claimed in claim 7, a plurality of side-by-side, substantially horizontal tubes extending in a forward-to-rearward direction relative to said machine and along the lower side of said three-side enclosure at a level at which reinforcing rods are to be placed in said wet concrete.

9. A machine as claimed in claim 8, wherein the forwardmost, entrant ends of said tubes are ahead of said cross wall.

10. A machine as claimed in claim 8, wherein the rearward, exit ends of said tubes are near and below said spreader means.

11. A machine as claimed in claim 8, wherein the forwardmost, entrant ends of said tubes are ahead of said cross wall and the rearward, exit ends of said tubes are near and below said spreader means.

12. A machine as claimed in claim 7, and a strike-off blade mounted on and extending transversely across said frame rearwardly of said spreader means, said blade defining the fourth side of said enclosure.

13. A machine as claimed in claim 7, a pair of wheels on opposite sides of the forward portions of said three-sided enclosure, and means for selectively and adjustably raising or lowering the height of said forward portions relative to said wheels.

14. A machine as claimed in claim 8, wherein the rearward, exit ends of said tubes are near and below said spreader means, said spreader means embodying at least one power-driven, rotatable auger extending transversely across and ahead of said frame, and strike-off means mounted on said frame and extending transversely thereacross in a position adjacent to and rearwardly of said spreader means.

15. A machine as claimed in claim 8, and means mounting the rearward, exit ends of said tubes on said frame at variable heights relative to said frame, thereby providing different levels at which the reinforcing rods may be laid in the spread, wet concrete.

16. A machine as claimed in claim 1, and means for adjusting the height relative to said frame of the rearward, exit ends of said tubes, thereby providing different levels at which the reinforcing rods may be laid in the spread, wet concrete.

* * * * *